US005713381A

United States Patent [19]

Sloane

[11] Patent Number: 5,713,381

[45] Date of Patent: Feb. 3, 1998

[54] EYE CARE KIT

[76] Inventor: Terri Sloane, 300 E. 74th St., New York, N.Y. 10021

[21] Appl. No.: 747,123

[22] Filed: Nov. 8, 1996

[51] Int. Cl.[6] ..... A45D 40/18

[52] U.S. Cl. ..... 132/312; 132/316; 132/314; 206/581

[58] Field of Search ..... 132/294, 295, 132/301, 312, 314, 316, 315, 297; 206/376, 377, 553, 581, 5.1, 569, 539, 38, 530, 6

[56] References Cited

U.S. PATENT DOCUMENTS

| | | | |
|---|---|---|---|
| 847,254 | 3/1907 | Jackson | 206/553 |
| 860,264 | 7/1907 | Stevens | 206/5 |
| 1,359,319 | 11/1920 | Brenan . | |
| 1,656,785 | 2/1928 | Foster . | |
| 1,719,120 | 7/1929 | Miles . | |
| 1,809,517 | 6/1931 | Katrinak | 132/297 |
| 2,042,584 | 6/1936 | Bustamante . | |
| 2,303,986 | 4/1942 | Carvos . | |
| 2,547,779 | 8/1951 | Renyck . | |
| 3,524,537 | 8/1970 | Winter . | |
| 3,534,887 | 10/1970 | Ginsberg . | |
| 3,759,375 | 9/1973 | Nappi . | |
| 4,301,916 | 11/1981 | Handelman | 206/38 |
| 4,796,750 | 1/1989 | Inghram . | |
| 4,913,682 | 4/1990 | Shabo . | |
| 4,951,811 | 8/1990 | Lines | 206/5.1 |
| 5,441,153 | 8/1995 | Lahaye . | |
| 5,533,534 | 7/1996 | Cariello et al. | 132/314 |

FOREIGN PATENT DOCUMENTS

| | | | |
|---|---|---|---|
| 244741 | 5/1947 | Switzerland | 206/38 |
| 772105 | 4/1957 | United Kingdom | 206/539 |

*Primary Examiner*—Todd E. Manahan
*Assistant Examiner*—E. Robert

[57] ABSTRACT

The present invention relates to an eye care kit which includes a pouch having a back panel and a front panel which partially overlaps the back panel. The front and back panels are connected along a plurality of seams which form a plurality of pockets. A plurality of individually packaged eye care products, such as contact lens solutions, artificial tears, and the like, are placed and retained in the pockets. The eye care kit may also include a holder panel overlapping the pouch with the back panel sandwiched between the front panel and the holder panel. The holder panel connects with the pouch along its side and bottom edges so that the back panel and the holder panel form an additional compartment therebetween. This compartment can be used to hold contact lens cases and lens paper for cleaning glasses, mascara, lipstick, money or other items.

20 Claims, 4 Drawing Sheets

EYE CARE KIT

FIELD OF THE INVENTION

The present invention relates to an eye care kit which can hold a plurality of individually packed eye care products and still be conveniently carried in the user's purse or pocket. The present invention also relates to a wallet or other carrying case for holding individually packed eye care products in addition to money.

BACKGROUND OF THE INVENTION

Due to the increased use of contact lenses, individually packaged eye care products, such as eye drops, artificial tears and contact lens solutions, have become very popular. These products can be made in travel or "mini" sizes. Also, a contact lens case is typically carried for storage of contact lenses when not in use.

These individually packaged eye care products avoid the need for carrying or transporting bulky containers and are convenient for users particularly when they are away from home or on travel such products are generally used once before the package or container is disposed. After purchasing such products, the user usually just takes a few packages and leaves them loosely in his or her pocket or purse. When the user needs to use such eye care products, she often has to seek for one package among many other items inside her purse. Since the individually packaged eye care products and contact lens are relatively small in size, they tend to fall to the very bottom of the purse and therefore even make it more difficult for the user to locate the product.

U.S. Pat. Nos. 1,359,319, 1,719,120, 4,796,750 and 5,441,153 disclose different kinds of containers used for holding and organizing various items such as coins, keys, and lipstick and similar items. However, a holder suitable for containing individually packed eye care products is not taught or suggested.

It is therefore desirable to provide an eye care kit or case which can hold multiple individually packaged eye care products such as preservative-free artificial tears, eye drops, contact lenses and their solutions, and be still convenient for the user to transport and use. The present invention provides one such design which meets these requirements.

SUMMARY OF THE INVENTION

The present invention relates to an eye care kit comprising a pouch which includes a back panel, and a front panel which at least partially overlaps the back panel, said front panel having top side and bottom edges, with the front and back panels being joined by a plurality of seams which form a plurality of pockets, and a plurality of individually packaged eye care products each placed respectively in a pocket and retained therein. This kit generally includes a flap extending from one of the edges of the pouch and being foldable towards the front panel to cover the same. This flap can extend from a side edge of the pouch and be foldable toward the front panel. In addition, a folding member originating from a seam and extending across the back panel can be included.

It is desirable to include a mirror on the flap to facilitate application of the eye care product. This mirror can be made of metallized plastic to avoid breakage when the kit is handled roughly. Also, a detachable fastener attached to the flap and one of the front and the back panels can be included for holding the eye care kit in a closed position.

When additional compartments are desired, a holder panel overlapping the pouch can be provided, with the back panel being sandwiched between the front panel and the holder panel and being connected to the pouch along the side and bottom edges thereof, with the back panel and the holder panel forming a pocket or compartment therebetween.

A specific embodiment of this kit is as a wallet. Two pouches can be connected to the holder panel, and separated by the folding member. Again, if desired, a flap extending from one edge of the holder panel can be provided, the flap being foldable towards one or both of the pouches. In this design, the pockets of one pouch are positioned in a staggered configuration to those of the other pouch to provide a compact construction.

Conveniently, the bottom edges of the two pouches are connected to a pair of opposed edges of the holder panel, with the two pouches are arranged side by side. It is useful for the panels to be made of flexible material, so that the panels can be sewed together along the seams. In this arrangement, the detachable fastener is preferably a VELCRO closure, although a button, snap, hook and eye, zipper or like closure can be used.

BRIEF DESCRIPTION OF THE DRAWINGS

These and other features, aspects, and advantages of the present invention will become much more apparent from the following description, appended claims, and accompanying drawings, in which:

DETAILED DESCRIPTION OF THE PREFERRED EMBODIMENT

Figure 1:
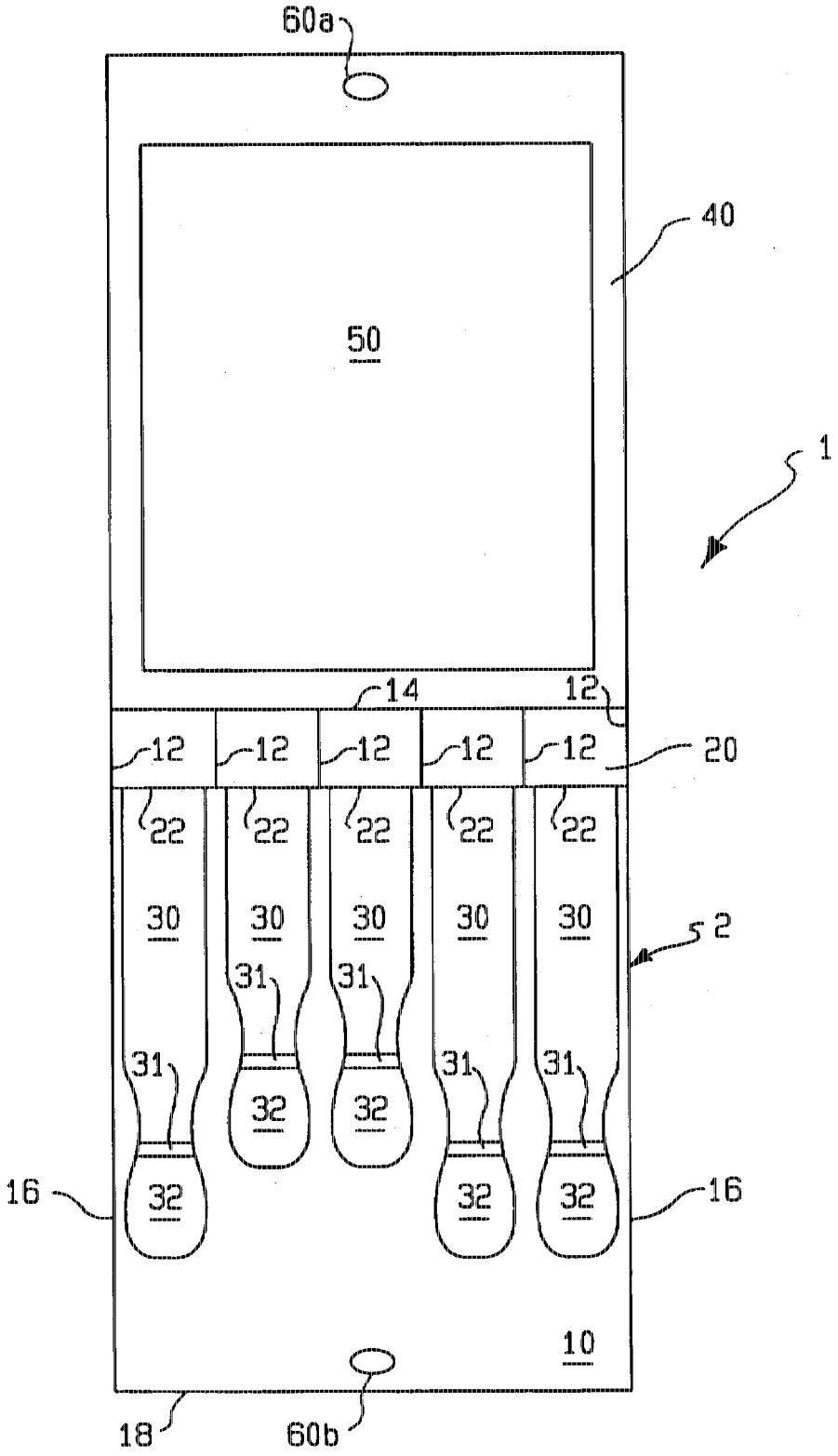
FIG. 1 shows an eye care kit according to of the present invention when it is in an open position.

The purpose of the present invention is to provide a compact, convenient, carrying case or storage member for preservative free artificial tears, eye drops, contact lens solutions, eye medications, or other solutions which are packaged in individual use containers. Such solutions are typically used for treating dry eyes or in post surgical eye treatments, as well as in routine eye care for contact lens wearers. Many of these solutions are preservative-free so that they must be disposed of after being opened and used to avoid contamination.

Various eye care kits embodying the principles of the present invention are illustrated in FIGS. 1–5. These eye care kits have a compact structure and can be easily carried in a purse or a jacket pocket. Therefore, the eye care kits of the present invention are convenient for transport and use. In each embodiment, the same elements are designated with the same reference numerals and repetitive descriptions are omitted.

Figure 2:
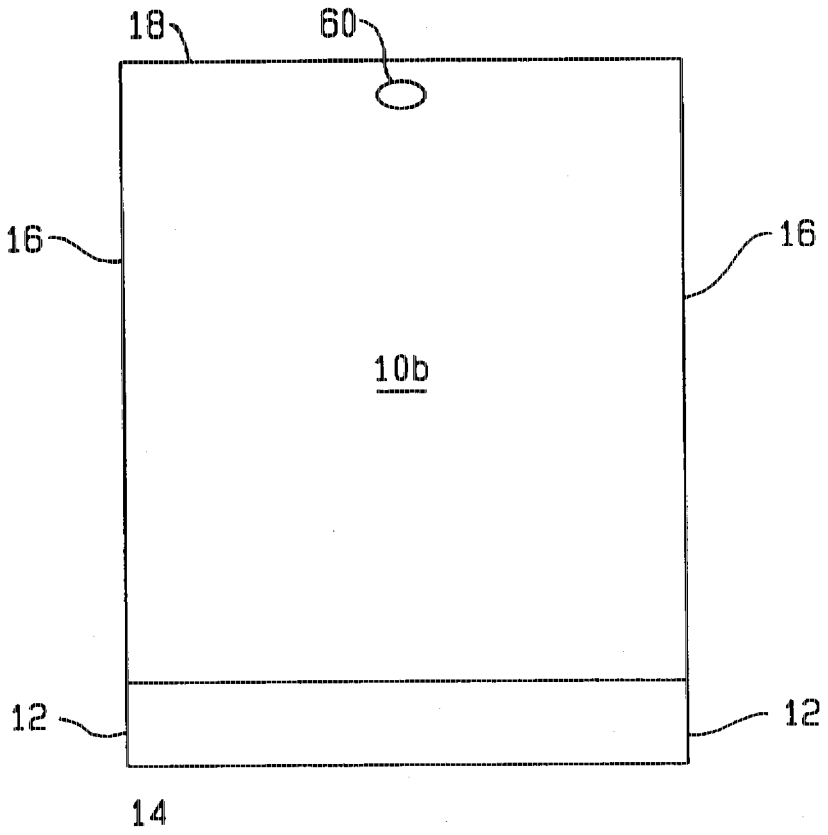
FIG. 2 is the eye care kit of FIG. 1 when folded into a closed position.

FIGS. 1 and 2 illustrate a first embodiment, where the eye care kit 1 has a pouch 2 which includes a back panel 10 with inner 10*a* and outer 10*b* sides. The back panel 10 is preferably square or rectangular. The pouch 2 further comprises a front panel 20 which partially overlaps the first side 10*a* of the back panel 10. The front and back panels 20, 10 are connected to each other along a plurality of side seams 12 and a bottom seam 14. These seams also form a plurality of pockets 22. While five pockets 22 are shown in FIG. 1, the number of the pockets 22 can vary over a wide range, with between about 2 to 12 pockets being preferred when compactness of the kit is desired. The front and back panels are conveniently made of a fabric, preferably a durable fabric such as nylon, although other fabrics or plastic materials can be used.

The eye care kit 1 of the present invention also comprises a plurality of individually packaged eye care products 30 that are configured and dimensioned to fit into the pockets 22 and which are retained therein. In the most preferred embodiment, these products are in the form of elongated plastic tubes which contain small amounts of saline, wetting solution, cleaning solution, eye drops, contact lens solutions or other eye care solutions. Generally, these tubes hold about 0.2 to 1 ml of solution, and include a weakened neck portion 31 which can be broken when the user engages and pulls on end portion 32. After the neck portion 31 is broken, the solution in the tube can be dispensed. As shown in FIG. 1, these tubes can be of different sizes depending upon the type of solution contained therein. Generally, these tubes will contain 10 ml or less so that the size of the tubes remains sufficiently small to keep the overall size of the kit manageably compact and transportable. After the use of any particular solution, the user can discard the depleted tube and insert a new tube in the pocket. The pockets can be the same height as the individual containers, but preferably are not higher than the tear off top portions.

A flap 40 extends from the bottom seam 14 of the back and front panels 10, 20 and is the same dimension as the back panel 10. This flap 40 is a cover for the pockets 22 and packaged eye care products 30. As variations of the illustrated embodiment, the flap 40 can extend from either of the other two side edges 16 or the top edge 18 of the pouch 2. Further, the flap 40 and the back panel 10 can be made as an integral piece, which is foldable along the seam 14 between the flap and the panels. When folded upon the front panel 20, the flap 40 covers the pockets 22 and provides a closed position for the kit (see FIG. 2). This conveniently protects the tubes from exposure to contaminants and from being removed inadvertently from the pockets.

A detachable fastener 60, such as a snap, magnet or VELCRO closure can be provided. The fastener 60 typically has two portions 60*a* and 60*b* attached to the flap 40 and the back panel 10, respectfully. Upon closing of the fastener 60, the eye care kit 1 is maintained in the closed position.

To facilitate the user when applying the eye care products, an optional mirror 50 may be provided on the inner side of the flap 40. This mirror can be made of any particular material, but a metallized plastic is preferred to minimize breakage during transport and handling of the kit.

In a preferred embodiment, the back and front panels 10, 20 and the flap 40 can be made of a rigid material, such as metal, wood or plastic. These materials provide better protection for the eye care products and avoid crushing. The back and front panels 10, 20 can thus be connected by welding, adhesives or mechanically. The eye care kit 1 provided by this embodiment may be designed similar to a cosmetic case except that pockets 22 particularly organized for receiving individually packed eye care products 30 are included.

Figure 4:
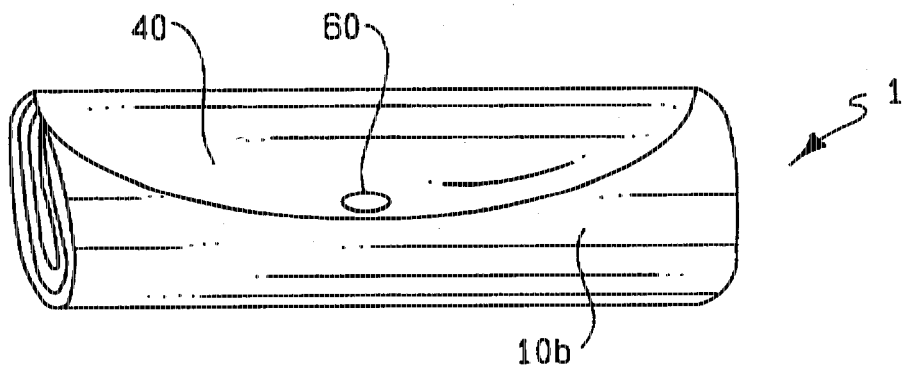
FIG. 4 shows the eye care kit of FIG. 3 when rolled into a closed position.
Figure 3:
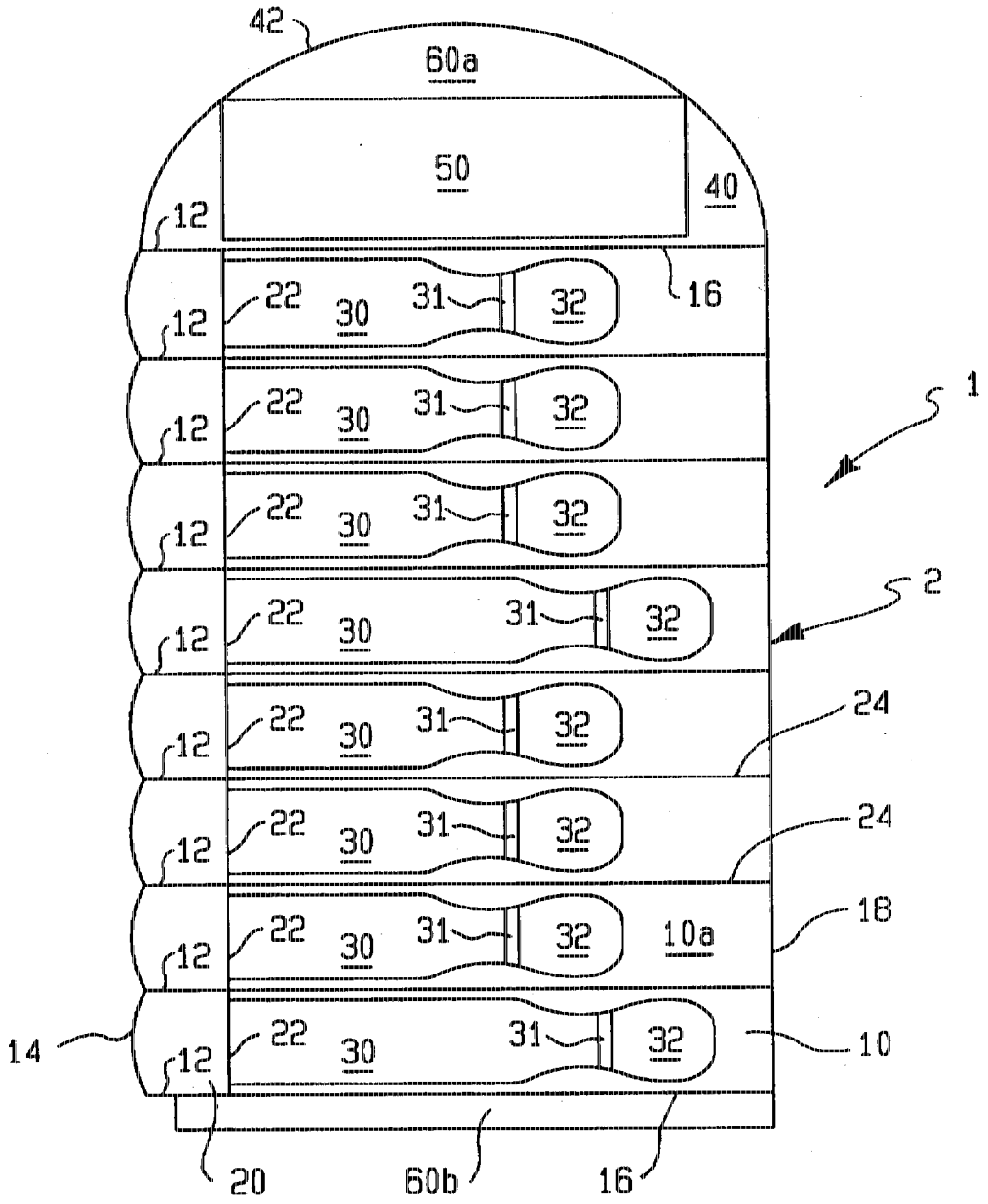
FIG. 3 shows an alternative embodiment of an eye care kit in an open position.

In an alternative embodiment illustrated in FIGS. 3–4, the back and front panels 10, 20 and the flap 40 can be made of flexible materials, such as fabric. In this case, the back and front panels 10, 20 can be sewed together along the seams 12, 14. In this embodiment, a detachable fastener 60 of a VELCRO type closure is preferred. The eye care kit 1 obtained according to the alternative embodiment is constructed similar to a soft wallet with its interior particularly designed with pockets for restraining the eye care products 30.

To use the eye care kit 1 of the present invention, individually packed eye care products 30 are first selected and inserted into the pockets 22. Then, the eye care kit 1 can be closed and put in to a purse, a briefcase or even a coat, pants or jacket pocket so that the user can carry the eye care kit 1 around as he or she wishes. When the eye care products 30 are needed, the user can simply take out the eye care kit 1, open it, and remove one or more eye care products 30 from the pouch 2 by grasping the exposed top portion 32. The user can then apply the eye care products 30 to herself with the help of the mirror 50 attached to the eye care kit 1. After applying, the remaining of the eye care products 30 can be deposed. The eye care kit 1 is to be closed and put back into the purse, briefcase or pocket.

In this embodiment, a total of eight pockets 22 are formed in the pouch 2, each of which is adapted for receiving one individually packed eye care product 30. A flap 40 extending from one side edge 16 of the pouch 2 is provided as a protective cover. The flap 40 is in the shape of semicircle having a flap tip 42 remote from the pouch 2. A mirror 50 is attached to the flap 40 on its inner side. The fastener 60 is in the form of VELCRO closures 60*a* and 60*b* attached to both the flap 40 next to the flap tip 42 and the pouch 2 at the other side of edge 16. Other closure members, such as snaps, buttons, hook and eye, zippers or the like can instead be used as desired.

The pouch 2 in the current embodiment is preferably made of a flexible material such as a natural or synthetic fabric or plastic material. In particular, a durable fabric such as nylon is preferred for long use, but any other conventional fabric materials, such as cotton or corduroy, can be used. A wide variety of plastic materials can also be used. In addition, there are folding members 24, such as seams, creases or folding lines, formed between the pockets 22 and overlapping the seams 12. These folding members 24 further extend across the back panel 10 to the top edge 18 of the pouch 2. Hence, the pouch 2, together with the eye care products 30 positioned therein, can be rolled up along the folding means 24 to a closed position. FIG. 4 shows a rolled-up eye care kit in which the flap 40 covers a major portion of the outer surface of the kit.

Figure 5:
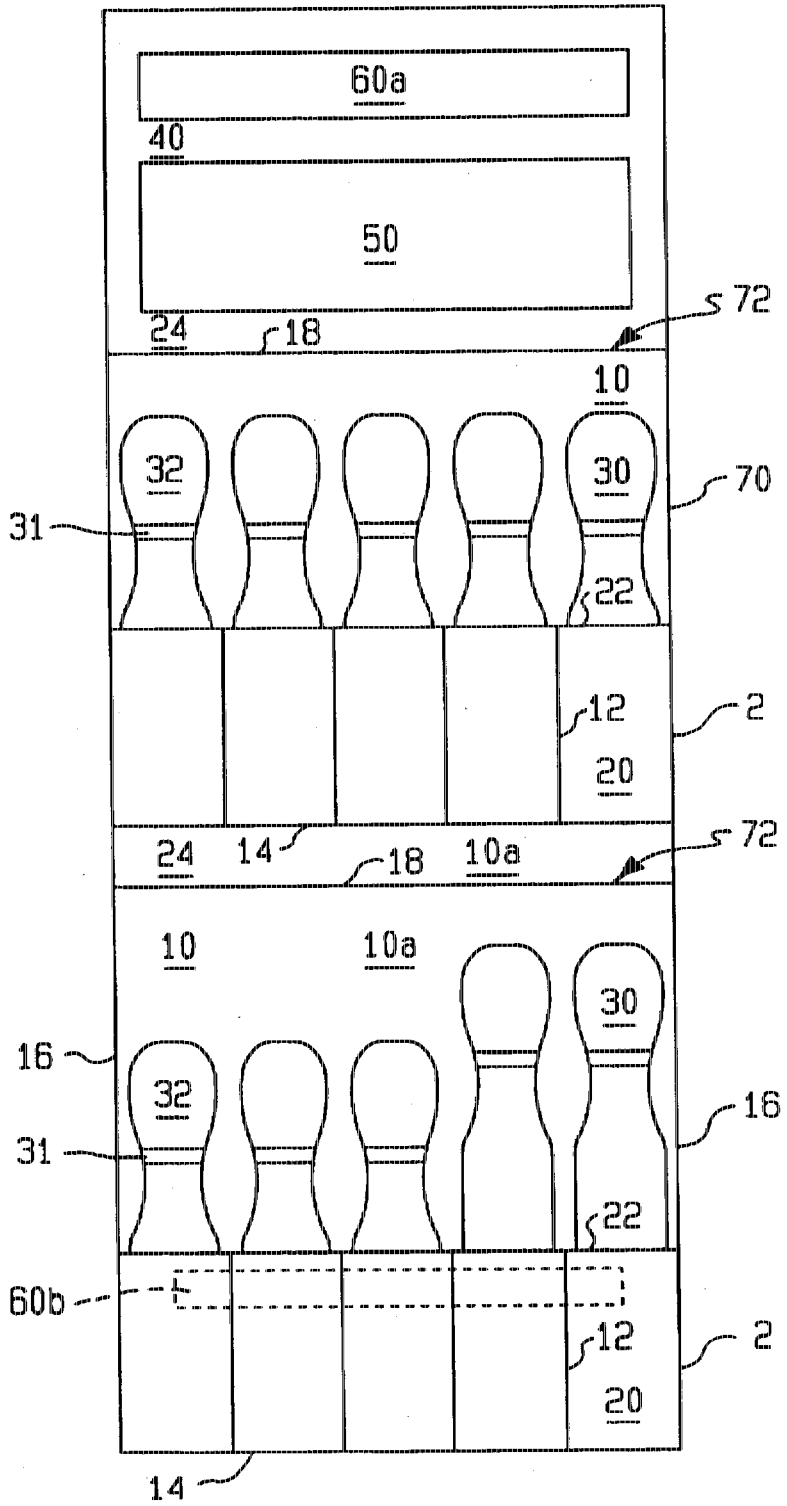
FIG. 5 shows yet another embodiment of an eye care kit in an open position.

FIG. 5 shows a third embodiment of the eye care kit 1 of the present invention. In this embodiment, a holder panel 70 is provided, which can be in a rectangular shape. Two pouches 2 are attached to the holder panel 70 with a folding means 24, such as a folding strip 24 on the holder panel 70 separating between them. The number of pouches 2 attached to the holder panel 70 preferably may be from 2–6. The back panels 10 is sandwiched between the front panels 20 and the holder panels 70 after the pouches 2 are attached to the holder panel 70.

The back panels 10 and the holder panels 70 form compartments 72 therebetween. The compartments 72 can be used for containing articles, such as individually packed tissues, contact lense cases, glasses cleaning paper, mascara, or other items (not shown). Such tissues are prepared for the convenience of the user to wipe off the excess eye care products 30 after such products are applied to the eyes.

In an alternative preferred embodiment where the eye care kit 1 is constructed as a wallet, the compartments 72 can be used to receive money bills or change, lipstick, breath freshner or similar products (not shown). In this embodiment, a preferred eye care kit 1 is the combination of an eye care product container and a money wallet.

According to the current preferred embodiment, a flap 40 is provided extending from an edge of the holder panel 70 instead of the back and front panels 10, 20 as described hereinabove. The flap 40 can be an integrated portion of the holder panel 70 or can be connected to the holder panel 70 through conventional means. Similar to the previous embodiment, the flap 40 is made foldable towards at least one pouch 2 along a folding member 24, such as a folding strip.

FIG. 5 shows that the two pouches 2 are arranged adjacently, one atop the other, with the seams 12 on one of the pouches 2 aligned with those of the other. However, the position of the pockets 22 in one pouch 2 are preferably staggered with respect to those of the other. Thus, individually packed eye care products 30 can be staggered so that the bulky portions of the products 30 in one pouch 2 can be positioned in the gaps formed by the products 30 in the other pouch 2. This arrangement facilitates in reducing the overall thickness of the eye care kit 1 when it is folded in a closed position.

There are various ways to arrange the pouches 2 relative to the holder panel 70. In a preferred embodiment, two pouches 2 are attached to the holder panel 70 with their bottom edges 14 oriented away from each other. If desired, the two pouches 2 can be arranged side by side.

In addition to use for routine contact lens handling, the eye care kits of the present invention can be used for allergy sufferers, dry eye treatments, post operative eye surgery treatments and the like. These kits are compact, portable and extremely convenient for everyday use.

The foregoing description is only illustrative of the principle of the present invention. It is to be recognized and understood that the invention is not to be limited to the exact configuration as illustrated and described herein. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. An eye care kit comprising:

a pouch which includes a back panel, and a front panel which at least partially overlaps the back panel, said front panel having top side and bottom edges, with the front and back panels being joined by a plurality of seams which form a plurality of pockets; and a plurality of plastic tubes of eye care solutions, each tube being configured and dimensioned to be placed respectively in a pocket and retained therein;

wherein the tubes include a weakened neck portion which can be broken to dispense the eye care solution.

2. The eye care kit of claim 1 further comprising a flap extending from one of the edges of the pouch and being foldable towards the front panel to cover the same.

3. The eye care kit of claim 2 further comprising a mirror on the flap.

4. The eye care kit of claim 3 wherein the mirror is made of metallized plastic and further comprising a detachable fastener attached to the flap and one of the front and the back panels for holding the eye care kit in a closed position.

5. The eye care kit of claim 1 further comprising a flap extending from a side edge of the pouch and being foldable toward the front panel, and a folding member originating from a seam and extending across the back panel.

6. The eye care kit of claim 5 further comprising a mirror on the flap and a detachable fastener attached to the flap and one of the front and the back panels for holding the eye care kit in a closed position.

7. The eye care kit of claim 1 further comprising a holder panel overlapping the pouch with the back panel being sandwiched between the front panel and the holder panel and being connected to the pouch along the side and bottom edges thereof, with the back panel and the holder panel forming a compartment therebetween.

8. The eye care kit of claim 7 further comprising a flap extending from the holder panel and being foldable toward the pouch, and a detachable fastener attached to the flap and one of the front, back and holder panels for maintaining the eye care kit in a closed position.

9. The eye care kit of claim 1, wherein the elongated plastic tubes comprise preservative free solutions of artificial tears, eye drops, contact lens solutions or eye medications in individual use containers which are subsequently disposed after being opened and used.

10. The eye care kit of claim 1, wherein the containers comprise plastic tubes which each hold a volume of about 0.2 to 1 ml of eye care solution.

11. The eye care kit of claim 10, wherein the pockets are configured and dimensioned to be not higher than the weakened neck portion of the tubes.

12. A wallet for holding individually packaged eye care products comprising:

a holder panel;

at least one pouch consisting of a pair of partially overlapped front and back panels and having top, side and bottom edges, the front and back panels being connected along a plurality of seams which form a plurality of pockets, the pouch overlapping the holder panel with the back panel sandwiched between the front panel and the holder panel, the pouch being connected to the holder panel along the side and bottom edges of the pouch to form an additional compartment; and a plurality of plastic tubes of eye care solutions, each tube being configured and dimensioned to be placed respectively in a pocket and retained therein;

wherein the tubes include a weakened neck portion which can be broken to dispense the eye care solution.

13. The wallet of claim 12 wherein two pouches are connected to the holder panel, the two pouches being separated by a folding member on the holder panel.

14. The wallet of claim 13 further comprising a flap extending from one edge of the holder panel, the flap being foldable towards one of the pouches.

15. The wallet of claim 14 further comprising a mirror on the flap and a detachable fastener attached to the flap and one of the front and back panels for retaining the wallet in a closed position.

16. The wallet of claim 13 wherein the bottom edges of the two pouches are connected to a pair of opposed edges of the holder panel.

17. The wallet of claim 13 wherein the panels are made of flexible material and the panels are sewed together along the seams.

18. The wallet of claim 13, where the elongated plastic tubes comprise preservative free solutions of artificial tears, eye drops, contact lens solutions or eye medications in individual use containers which are subsequently disposed after being opened and used.

19. The wallet of claim 13, wherein the containers comprise plastic tubes which each hold a volume of about 0.2 to 1 ml of eye care solution.

20. The wallet of claim 13 wherein the pockets are configured and dimensioned to be not higher than the weakened neck portion of the tubes.

* * * * *